US009759048B2

(12) United States Patent
LaGrange et al.

(10) Patent No.: US 9,759,048 B2
(45) Date of Patent: Sep. 12, 2017

(54) PERFORATING GUN FOR UNDERBALANCED PERFORATING

(71) Applicant: Owen Oil Tools LP, Houston, TX (US)

(72) Inventors: Timothy E. LaGrange, Rainbox, TX (US); Jeffrey Gartz, Blackfalds (CA)

(73) Assignee: OWEN OIL TOOLS LP, Houston, TX (US)

( * ) Notice: Subject to any disclaimer, the term of this patent is extended or adjusted under 35 U.S.C. 154(b) by 324 days.

(21) Appl. No.: 14/754,024

(22) Filed: Jun. 29, 2015

(65) Prior Publication Data

US 2016/0376877 A1 Dec. 29, 2016

(51) Int. Cl.

| | |
|---|---|
| ***E21B 43/116*** | (2006.01) |
| ***E21B 29/02*** | (2006.01) |
| ***E21B 43/117*** | (2006.01) |
| ***E21B 21/10*** | (2006.01) |
| ***E21B 34/06*** | (2006.01) |
| ***E21B 34/14*** | (2006.01) |
| *E21B 21/00* | (2006.01) |

(52) U.S. Cl.

CPC ..... *E21B 43/117* (2013.01); *E21B 21/103* (2013.01); *E21B 34/063* (2013.01); *E21B 34/14* (2013.01); *E21B 43/116* (2013.01); *E21B 2021/006* (2013.01)

(58) Field of Classification Search

CPC ..... E21B 29/02; E21B 43/116; E21B 43/117
See application file for complete search history.

(56) References Cited

U.S. PATENT DOCUMENTS

| | | | | |
|---|---|---|---|---|
| 2,866,508 | A * | 12/1958 | Church | E21B 49/087 102/310 |
| 4,515,217 | A * | 5/1985 | Stout | E21B 34/063 166/297 |
| 4,862,964 | A | 9/1989 | George et al. | |
| 5,058,674 | A | 10/1991 | Schultz et al. | |
| 5,088,557 | A | 2/1992 | Ricles et al. | |
| 5,103,912 | A | 4/1992 | Flint | |
| 5,287,741 | A | 2/1994 | Schultz et al. | |
| 5,551,344 | A | 9/1996 | Couet et al. | |

(Continued)

FOREIGN PATENT DOCUMENTS

| | | |
|---|---|---|
| EP | 0155128 A2 | 9/1985 |
| EP | 0415770 B1 | 3/1996 |

(Continued)

*Primary Examiner* — Kenneth L Thompson

(74) *Attorney, Agent, or Firm* — Mossman, Kumar & Tyler PC

(57) ABSTRACT

A perforating gun has shaped charges that can generate a high-pressure gas. A valve sub connects to the perforating gun and a reservoir sub connects to the valve sub. The valve sub has an enclosure with a port. A mandrel in the enclosure has a piston head and a fluid path extending at least partially through the mandrel. A sleeve is slidably mounted on the mandrel and selectively blocks fluid flow through the port. A pressure chamber in the sleeve receives the generated high-pressure gas via the fluid path. The sleeve slides toward the perforating gun after a predetermined pressure is created by the generated high-pressure gas in the pressure chamber. The reservoir sub may have at least one chamber in fluid communication with the interior of the valve sub.

9 Claims, 4 Drawing Sheets

(56) References Cited

U.S. PATENT DOCUMENTS

| | | | | |
|---|---|---|---|---|
| 6,536,524 | B1 * | 3/2003 | Snider | E21B 23/00 166/297 |
| 6,966,377 | B2 | 11/2005 | Johnson et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 7,428,921 | B2 | 9/2008 | Grove et al. | |
| 7,571,768 | B2 * | 8/2009 | Cuthill | E21B 43/1195 166/297 |
| 7,905,285 | B2 * | 3/2011 | Cuthill | E21B 43/1195 166/297 |
| 8,118,098 | B2 * | 2/2012 | Hromas | E21B 34/10 166/298 |
| 2008/0307951 | A1 * | 12/2008 | Kaiser | E21B 43/119 89/1.15 |
| 2015/0218910 | A1 * | 8/2015 | Ruby | E21B 43/116 166/297 |

FOREIGN PATENT DOCUMENTS

| | | | |
|---|---|---|---|
| GB | 2396175 | A | 6/2004 |
| GB | 2406114 | A | 3/2005 |
| GB | 2406865 | A | 4/2005 |
| WO | 99/42696 | A1 | 8/1999 |
| WO | 01/25595 | A1 | 4/2001 |
| WO | 01/65060 | A1 | 9/2001 |

* cited by examiner

PERFORATING GUN FOR UNDERBALANCED PERFORATING

CROSS REFERENCE TO RELATED APPLICATIONS

NONE

TECHNICAL FIELD

The present disclosure relates to devices and method for perforating a subterranean formation in an underbalanced condition.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun that is generally comprised of a steel tube "carrier," a charge tube riding on the inside of the carrier, and with shaped charges positioned in the charge tube. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In certain instances, it may be desirable to perforate the formation while the wellbore pressure is less than the formation pressure. This condition is known as an "underbalanced" condition. In an underbalanced condition, the fluid from the formation flows out of a newly formed perforation. This flow can clean the perforation of debris and improve production of resident hydrocarbons. The present disclosure addresses the need for perforating guns that can generate an underbalanced condition during a perforating activity.

SUMMARY

In aspects, the present disclosure provides a perforating gun that has: at least one shaped charge that generates a high-pressure gas when detonated, a valve sub connected to the perforating gun, and a reservoir sub connected to the valve sub. The valve sub may have an enclosure having at least one port providing fluid communication between an exterior and an interior of the valve sub, a mandrel disposed in the enclosure, the mandrel having a piston head and a fluid path extending at least partially through the mandrel, a sleeve slidably mounted on the mandrel, the sleeve selectively blocking fluid flow through the at least one port, and a pressure chamber defined by an inner surface of the sleeve and an outer surface of the piston head, the pressure chamber receiving the generated high-pressure gas via the fluid path, wherein the sleeve slides toward the perforating gun after a predetermined pressure is created by the generated high-pressure gas in the pressure chamber. The reservoir sub may have at least one chamber in fluid communication with the interior of the valve sub.

In further aspects, the present disclosure provides a dynamic underbalanced sub for use with a perforating gun having at least one shaped charge that generates a high-pressure gas when detonated. The dynamic underbalance sub may include a valve sub and a reservoir sub. The valve sub connects to the perforating gun and includes an enclosure having a longitudinal cavity and at least one port providing fluid communication between an exterior and the cavity, a mandrel disposed in the cavity and fixed to the enclosure, the mandrel having a piston head and a fluid path extending at least partially through the mandrel, the fluid path being in communication with an interior of the perforating gun, a tubular sleeve slidably mounted on the mandrel, the sleeve shifting from a first position and a second position inside the cavity, wherein the sleeve blocks fluid flow through the at least one port in the first position, and a pressure chamber defined by an inner surface of the sleeve and an outer surface of the piston head, the pressure chamber receiving the generated high-pressure gas via the fluid path, wherein the generated high-pressure gas in the pressure chamber displaces the sleeve to a second position wherein the at least one port is at least partially uncovered. The reservoir sub is coupled to the valve sub and may include at least one chamber in fluid communication with the cavity, wherein the sleeve slides away from the reservoir sub when shifting from the first position to the second position.

Still further aspects of the present disclosure relate to methods for perforating a formation using the disclosed perforating gun systems.

It should be understood that certain features of the disclosure have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
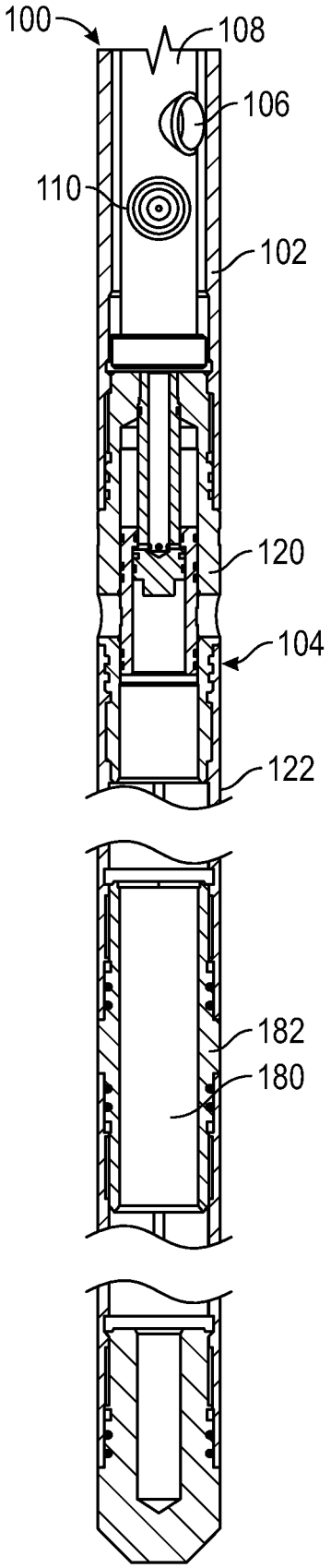
FIG. 1 schematically illustrates a side sectional view of a perforating gun with an underbalanced perforating sub according to one embodiment of the present disclosure.

The present disclosure relates to devices and methods for perforating a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown one embodiment of a perforating gun 100 in accordance with the present disclosure. For ease of discussion, devices such as boosters, electrical wiring, connectors, fasteners and detonating cords have been omitted. The perforating gun system 100 may include a gun 102 that perforates a section of a formation and a dynamic underbalance sub 104 (hereafter 'sub 104') that generates an underbalanced condition after the gun 102 fires. The gun 102 may include a carrier 106 that is shaped to receive a charge tube 108 and one or more shaped charges 110 that create jets for perforating a surrounding formation.

The sub 104 generates a temporary pressure drop in the wellbore immediately after the gun 102 fires. This temporary pressure drop allows formation fluid to flow through and clean the newly formed perforations. In one embodiment, the sub 104 includes a valve sub 120 and a reservoir sub 122. As used herein, the term "sub" refers to an assembly of components configured to perform one or more tasks and residing within a common structure such as a housing, frame, or enclosure. As discussed in greater detail below, the high pressure gas generated by the gun 102 actuates the valve sub 120, which then allows wellbore fluid to flow into the reservoir sub 122. The sudden inrush of fluid causes a pressure drop and the temporary (dynamic) underbalanced condition in the surrounding wellbore fluid. As noted previously, an underbalanced condition refers to a pressure environment wherein the wellbore pressure is less than the formation pressure.

Figure 2A:
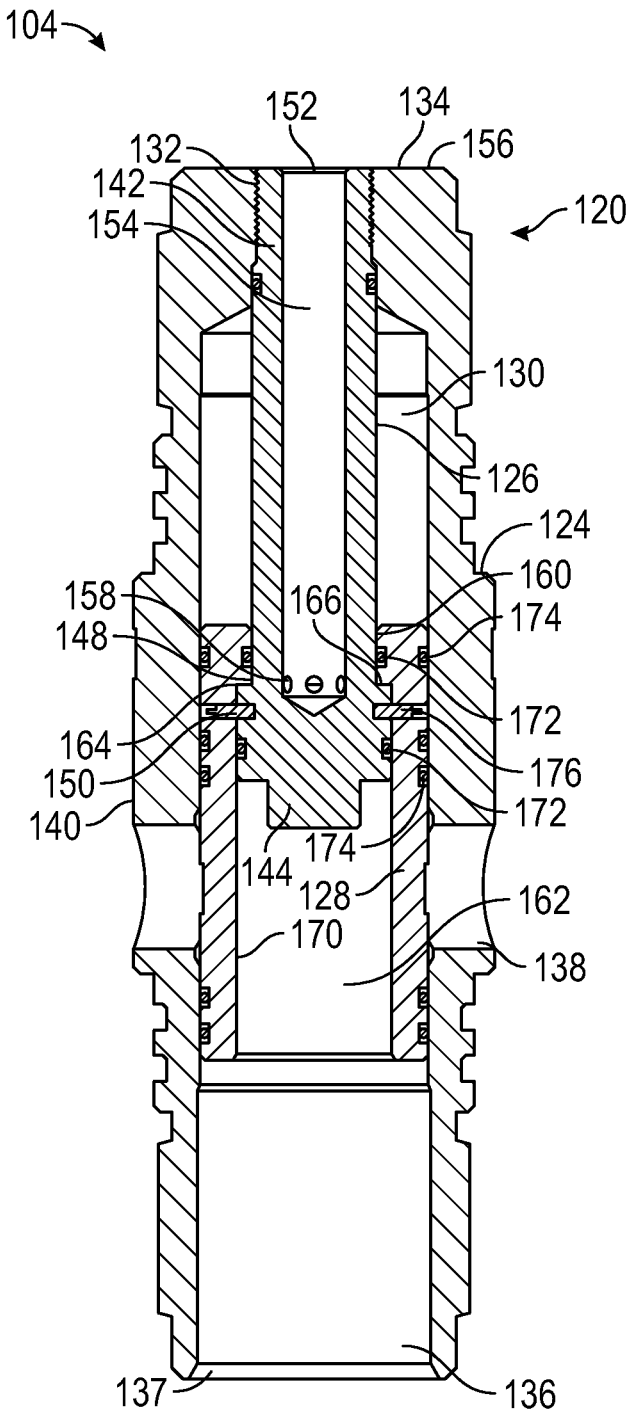
FIG. 2A schematically illustrates a sectional view of a portion of an underbalanced perforating sub according to one embodiment of the present disclosure.

Referring to FIG. 2A, the valve sub 120 may include an enclosure 124 in which are disposed a mandrel 126 and a sleeve 128. The enclosure 124 may include a longitudinal cavity 130 having a passage 132 at an upper end 134 and a mouth 136 at a lower end 137. The upper end 134 may be configured to connect with the gun 102 (FIG. 1) and the lower end 136 may be configured to connect with the reservoir sub 122 (FIG. 1). One or more ports 138 formed on a circumferential wall 140 allow fluid communication between an exterior of the valve sub 120 and the cavity 130. Fluid flow through ports 138 is controlled by moving the sleeve 128 axially along the mandrel 126.

The mandrel 126 may be a cylindrical member having a shaft 142 that terminates at a diametrically larger piston head 144. The shaft 142 may be fixed to the enclosure 124 and the piston head 144 has a surface that includes a pressure face 148 and an outer circumferential surface 150. The mandrel 126 also includes a fluid passage 152 that include a bore 154 that extends from an upper end 156 to one or more transverse openings 158 that are positioned to communicate with the pressure face 148. For instances, the bore 154 may be longitudinally aligned and the opening(s) 158 may radiate from the longitudinal bore 154.

The sleeve 128 may be a tubular member having a length sufficient to completely cover and thereby block flow through the ports 138 when in a pre-activated position. In the activated position, the sleeve 128 is axially spaced apart from and at least partially uncovers the ports 138. The sleeve 128 may have a first bore 160 formed complementary to the shaft 142 and a larger second bore 162 in which the piston head 144 is disposed. An annular pressure chamber 164 is formed at a shoulder 166 defining a juncture between the first bore 160 and the second bore 162. The pressure chamber 164 is defined by the pressure face 148 and an inner surface 170 of the sleeve 128. In some embodiments, a retaining member 176 may be used to selectively lock the sleeve 128 to the mandrel 126. For example, the retaining member 176 may be a shear pin that is configured to break when subjected to a known force.

In some embodiments, seals may be used to form fluid barriers within the enclosure 124. For example, seals 172 between the mandrel 126 and the sleeve 128 may be used to hydraulically isolate the pressure chamber 164 and seals 174 may be used to form fluid tight barriers between the sleeve 128 and the enclosure 124 to isolate the ports 138.

Additionally, in some embodiments, the shaft 142 and the passage 132 may be configured to provide a locking function. For instance, some or all of the passage 132 may be sized to be diametrically smaller than the shaft 142. Thus, when the shaft 142 is forced under pressure to slide through the passage 132, an interfering contact is formed, which can lock the shaft 142 to the enclosure 124.

Referring to FIG. 1, the reservoir sub 122 includes one or more interior chambers 180 for receiving wellbore fluids after the valve sub 120 is in the activated position. The chamber(s) 180 may be defined within one or more housings 182. In some arrangements, the reservoir sub 122 may have an adjustable volumetric capacity by using modular housings. For instance, the housings 182 may interconnect with one another. Thus, adding two housings will double the volumetric capacity and increase the available pressure drop.

Figure 3:
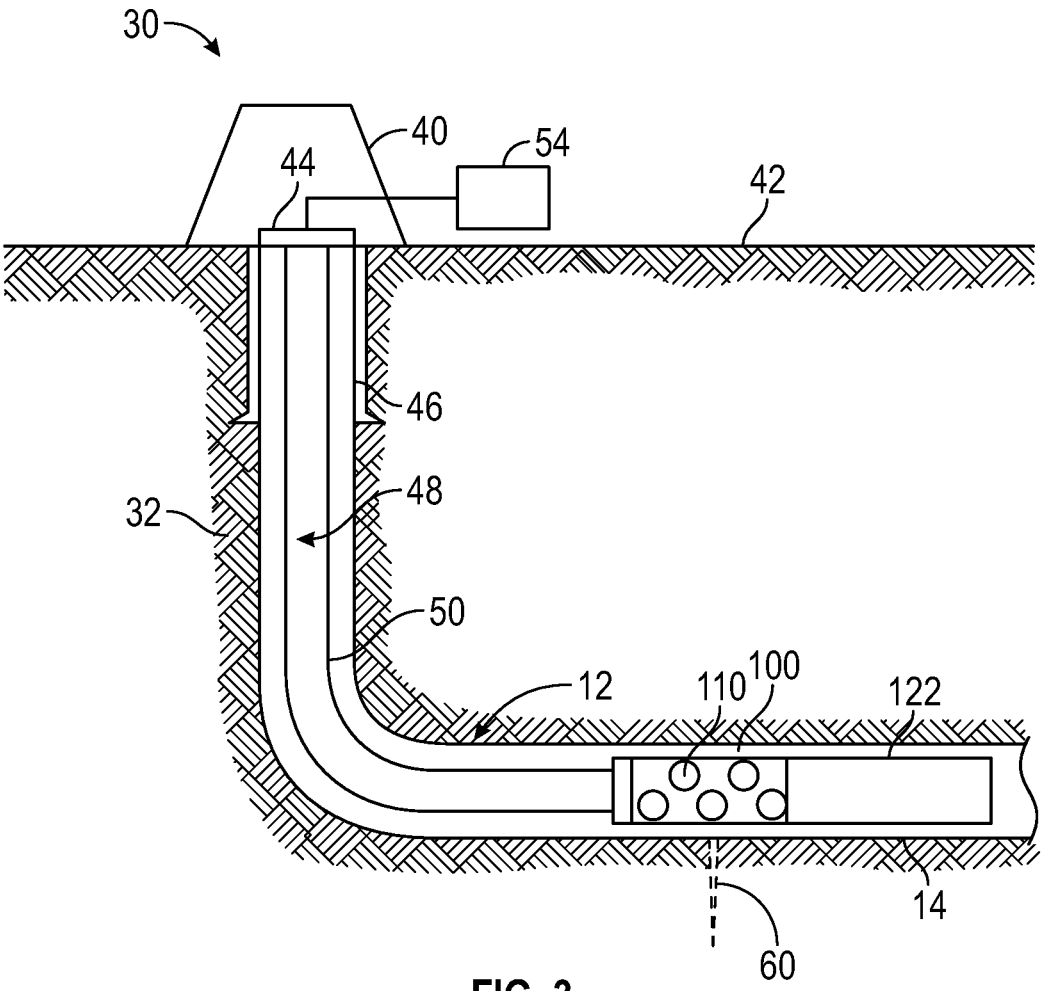
FIG. 3 schematically illustrates a well in which embodiments of the present disclosure may be deployed.

Referring to FIG. 3, there is shown a well construction and/or hydrocarbon production facility 30 positioned over subterranean formations of interest 32. The facility 30 can be a land-based or offshore rig adapted to drill, complete, or service the wellbore 12. The facility 30 can include known equipment and structures such as a platform 40 at the earth's surface 42, a wellhead 44, and casing 46. A work string 48 suspended within the well bore 12 is used to convey a perforating gun 100 into and out of the wellbore 12. The work string 48 can include coiled tubing 50 injected by a coiled tubing injector (not shown). Other work strings can include tubing, drill pipe, wire line, slick line, or any other known conveyance means. A surface control unit (e.g., a power source and/or firing panel) 54 can be used to monitor and/or operate tooling connected to the work string 48.

Figure 2B:
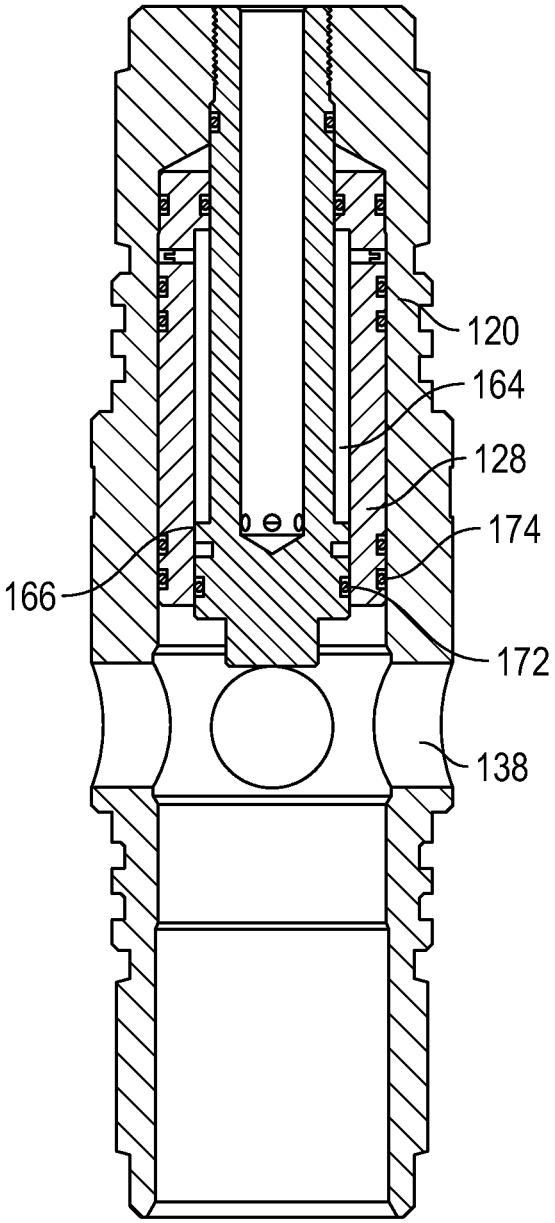
FIG. 2B schematically illustrates the FIG. 2A embodiment in an activated state.

Referring to FIGS. 1-3, in one illustrative method of use, the gun 100 is first positioned at a desired location in the wellbore 12. In the pre-activated state, the sleeve 128 blocks the openings 138 and the interior of the reservoir sub 122 is empty of liquids and at a pressure lower than the ambient formation pressure (e.g., substantially atmospheric pressure). When fired, the shaped charges 110 create jets that form perforations or tunnels 60 into the adjacent formation 32. Immediately thereafter, high pressure gas generated by the detonation of the shaped charges 110 flows from the interior of the gun 100 through the fluid passage 152 and into the pressure chamber 164. After it reaches a predetermined value, the pressure in the pressure chamber 164 breaks the retaining member 176 and pushes the sleeve 128 axially upward, which uncovers the openings 138 as shown in FIG. 2B. It should be appreciated that the sliding motion of the sleeve 128 is axially upward toward the perforating gun 100 and away from the reservoir sub 122. Moreover, the shoulder 166 prevents the sleeve 128 from sliding toward the reservoir sub 122. Thus, the sleeve 128 is retained within the valve sub 120.

Now that the valve sub 120 has been activated, wellbore fluid surrounding the perforating gun 100 can flow through the openings 138 and into the chambers of the reservoir sub 122. The seals 172 and 174 prevent this flow from flowing upward to the perforating gun 100. This inflow of fluid causes a transient reduction in surrounding wellbore pressure and an underbalanced condition. This underbalanced condition promotes the flow of formation fluid out of the newly formed perforation tunnels 60.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A perforating tool, comprising:

a perforating gun having at least one shaped charge, the at least one shaped charge generating a high-pressure gas when detonated;

a valve sub connected to the perforating gun, the valve sub having:

an enclosure having at least one port providing fluid communication between an exterior and an interior of the valve sub, a mandrel disposed in the enclosure, the mandrel having a piston head and a fluid path extending at least partially through the mandrel, a sleeve slidably mounted on the mandrel, the sleeve selectively blocking fluid flow through the at least one port, and a pressure chamber defined by an inner surface of the sleeve and an outer surface of the piston head, the pressure chamber receiving the generated high-pressure gas via the fluid path, wherein the sleeve slides toward the perforating gun after a predetermined pressure is created by the generated high-pressure gas in the pressure chamber; and a reservoir sub coupled to the valve sub, the reservoir sub having at least one chamber in fluid communication with the interior of the valve sub.

2. The perforating tool of claim 1, wherein the at least one port is in fluid communication with the at least one chamber after the sleeve slides toward the perforating gun to generate an underbalanced condition.

3. The perforating tool of clam 1, wherein the piston head is formed on an end of a shaft of the mandrel, wherein the sleeve includes a first bore in which the shaft is disposed and a second bore receiving the piston head, wherein a shoulder is formed at a juncture between the passage and the bore, the shoulder being positioned between the piston head and the perforating gun.

4. The perforating gun of claim 1, wherein the enclosure has a first end proximate to the perforating end, a second end proximate to the reservoir sub, and a bore in which the sleeve translates between a first position and a second position, wherein the sleeve completely covers the at least one port in the first position and at least partially uncovers the at least one port in the second position.

5. The perforating gun of claim 1, wherein the enclosure has a first end proximate to the perforating end and a second end proximate to the reservoir sub, and wherein the sleeve is proximate to the reservoir sub in the first position and proximate to the perforating gun in in the second position.

6. A dynamic underbalanced sub for use with a perforating gun having at least one shaped charge that generates a high-pressure gas when detonated, the dynamic underbalance sub comprising:

a valve sub connected to the perforating gun, the valve sub having:

an enclosure having a longitudinal cavity and at least one port providing fluid communication between an exterior and the cavity, a mandrel disposed in the cavity and fixed to the enclosure, the mandrel having a piston head and a fluid path extending at least partially through the mandrel, the fluid path being in communication with an interior of the perforating gun, a tubular sleeve slidably mounted on the mandrel, the sleeve shifting from a first position and a second position inside the cavity, wherein the sleeve blocks fluid flow through the at least one port in the first position, and a pressure chamber defined by an inner surface of the sleeve and an outer surface of the piston head, the pressure chamber receiving the generated high-pressure gas via the fluid path, wherein the generated high-pressure gas in the pressure chamber displaces the sleeve to a second position wherein the at least one port is at least partially uncovered; and a reservoir sub coupled to the valve sub, the reservoir sub having at least one chamber in fluid communication with the cavity, and wherein the sleeve slides away from the reservoir sub when shifting from the first position to the second position.

7. The dynamic underbalance sub of claim 6, wherein the piston head is formed on an end of a shaft of the mandrel, and wherein the sleeve has a first bore formed complementary to the shaft and a larger second bore in which the piston head is disposed.

8. The dynamic underbalance sub of claim 6, further comprising a first set of seals between the enclosure and the sleeve, and a second set of seals between the sleeve and the mandrel, the first and the second set of seals isolating the perforating gun from a fluid flowing through the at least one port.

9. The dynamic underbalance sub of claim 6, further comprising a retaining member selectively locking the sleeve to the mandrel.

* * * * *